US005280663A

United States Patent [19]

Proulx

[11] Patent Number: 5,280,663

[45] Date of Patent: Jan. 25, 1994

[54] SCRUBBER GUARD

[76] Inventor: Linda L. Proulx, 5380 SE. Drake Rd., Hillsboro, Oreg. 97123

[21] Appl. No.: 738,243

[22] Filed: Jul. 29, 1991

[51] Int. Cl.[5] ..... A47L 11/162

[52] U.S. Cl. ..... 15/246; 15/50.1; 51/177

[58] Field of Search ..... 15/49.1, 50.1, 98, 246

[56] References Cited

U.S. PATENT DOCUMENTS

| | | | |
|---|---|---|---|
| 2,981,966 | 5/1961 | Beffel | 15/246 |
| 3,010,135 | 11/1961 | Pollnow | 15/246 |
| 3,122,769 | 3/1964 | Doersam | 15/246 |
| 3,153,251 | 10/1964 | Ohlson | 15/50 |
| 3,293,678 | 12/1966 | South | 15/29 |
| 3,733,635 | 5/1973 | Carden | 15/246 X |
| 4,330,897 | 5/1982 | Tucker et al. | 15/246 |
| 4,510,643 | 4/1985 | Kitada | 15/320 |
| 4,903,364 | 2/1990 | Long | 15/50 |

FOREIGN PATENT DOCUMENTS

| | | | |
|---|---|---|---|
| 1417926 | 12/1975 | United Kingdom | 15/246 |

*Primary Examiner*—Chris K. Moore
*Attorney, Agent, or Firm*—Klarquist, Sparkman, Campbell, Leigh & Whinston

[57] ABSTRACT

A floor scrubbing apparatus has rotating pads and a flexible scrubber guard that encompasses the scrubber during floor scrubbing operations. The scrubber guard protects a work area from contact damage and liquid splash. The scrubber guard comprises a flexible wall having a top edge, an arcuate bottom edge, and continuous, vertically extending interior and exterior surfaces. Parallel, latitudinally positioned ribs project outwardly from, and extend around the entire circumference of, the interior surface of the scrubber guard. These ribs increase the scrubber guard's ability to intercept liquid splash. The arcuate bottom edge allows the scrubber guard to lift upwardly, relative to the surface of a floor, when the exterior surface encounters a vertical structure such as a wall. The arcuate bottom edge also inhibits power cord entanglement with the rotating cleaning pads.

8 Claims, 3 Drawing Sheets

SCRUBBER GUARD

This invention relates to guards that encompass the scrubbing pads of floor cleaning apparatuses during floor cleaning operations. Such scrubber guards inhibit liquid splash and contact damage to objects and walls in the work area.

BACKGROUND OF THE INVENTION

Floor cleaning devices typically comprise a frame, a number of motor-driven rotary pads or brushes, a motor, and a handle pivotally mounted to the frame. The rotary pads or brushes repetitively abrade the surface of a floor as a worker, using the pivotally mounted handle, guides the apparatus over the floor.

Damage to furniture and walls can result if there is inadvertent contact with the scrubbing mechanism. And, with modern machines having drive blocks that rotate at high speeds, there is a tendency for liquid from the floor to splash onto nearby objects. Workers must therefore spend time and effort to avoid damaging objects in the work area and must clean the residue of splashed liquid from walls, furniture and the like.

Floor cleaning machines may also be hazardous to the operator because the rotary cleaning pads or brushes can entangle the machine's power cord. In the presence of cleaning solution contact with the power cord may result in electric shock to the worker.

There are devices intended to prevent damage to work areas resulting from contact with floor cleaning machines and from cleaning solution splash. These are scrubber guards that surround the scrubbing mechanism of a scrubbing machine. Many prior scrubber guards are limited by the fact that they are either directly attached to, or are intended for use with, a particular machine. Examples of such devices can be found in U.S. Pat. Nos. 3,153,251, 4,510,643 and 4,903,364.

U.S. Pat. No. 3,122,769 (Doersam) describes a splash guard that is not attached to floor cleaning apparatus. Doersam's splash guard is made of a rigid, plastic material comprising a smooth annular wall having a rigid flange located adjacent one edge. The flange extends outwardly from and at a right angle to the exterior surface of the wall. Doersam's guard also includes oppositely disposed notch portions that permit the ingress and egress of cleaning solution to and from the region enclosed by the guard.

A rigid, free-floating splash guard tips when pushed against an object on the exterior of the guard, unless the scrubbing machine contacts the guard at a location that is directly opposite the location where the guard contacts the exterior object. When such a guard tips, liquid splash occurs and the guard fails to perform its intended function.

Doersam's guard addressed this problem by extending the rigid horizontal flange outwardly from the exterior surface of the guard. The flange contacts a wall or baseboard before the guard does. This prevents tipping if the force exerted by the baseboard on the exterior surface of the guard is directly opposed by the force applied by the scrubbing machine to the interior surface of the guard. Doersam's guard is intended for use on both hard surface floors and carpet by flipping the guard over. When the flange is not resting on the floor, the force applied by the cleaning machine to the interior surface of the guard may not be directly opposed by a force applied to the exterior surface of the guard. Thus, the problems associated with guard tipping are not alleviated by Doersam's splash guard.

The rigid construction of Doersam's splash guard and outwardly extending flange also prevents the splash guard from conforming to obstacles and work areas. This in turn prevents the cleaning machine from entering work areas smaller than the guard but otherwise accessible to the cleaning machine.

SUMMARY OF THE INVENTION

A floor scrubbing apparatus having motor-driven rotary scrubbing pads is encompassed by a flexible scrubber guard during a floor cleaning operation. To clean a floor, cleaning solution is first placed on the floor surface. The scrubber guard is then placed around the rotary cleaning pads of the floor cleaning apparatus in an encompassing relationship so that a portion of the cleaning solution is also encompassed by the guard. A worker then moves the scrubbing apparatus across the upper surface of the floor. The scrubber guard maintains its encompassing relationship around the rotating cleaning pads and protects the work area from direct contact with the scrubbing apparatus and from cleaning solution splash.

The scrubber guard comprises a flexible band or annular wall having a top edge, a bottom edge, and continuous, vertically extending interior and exterior surfaces devoid of ingress or egress perforations. The scrubber guard is flexible and bends and conforms to objects that contact the interior or exterior surfaces. The interior surface of the scrubber guard has parallel, latitudinally spaced ribs that project outwardly from, and extend around, the entire circumference of the interior surface. These ribs intercept cleaning solution splash projected tangentially by the rotating scrubbing pads.

The wall of the scrubber guard flares at the bottom to provide a flange or bottom portion that is arcuate. This bottom arcuate portion has a convex inner surface and a concave outer surface. The arcuate bottom portion allows the scrubber guard to rise upwardly, relative to the surface of a floor, when the exterior surface of the scrubber guard encounters an object and the cleaning apparatus applies a force to the interior surface. When the guard encounters the power cord, the arcuate edge acts as a ramp that lifts the power cord to inhibit it from sliding under the guard to a position where the cord could become entangled with the rotating scrubbing pads.

An object of the present invention is to provide a scrubber guard that can be used in tight spaces and that allows a scrubber to operate in close proximity to objects outside the guard.

Another object of the present invention is to provide a scrubber guard that retains cleaning liquid near the pads of a scrubber.

Another object of the present invention is to provide a scrubber guard that does not tip in response to a force applied by an object contacting the exterior surface and a force applied to the interior surface of the scrubber guard by the floor scrubbing apparatus.

Also an object is to provide a scrubber guard that has a smooth interior surface that will not catch on rotating scrubber pads.

Another object of the present invention is to alleviate dangers presented to workers as a result of power cord entanglement with the rotating scrubbing mechanisms.

A further object is to provide a scrubber guard that can be used with numerous types of floor scrubbers and that can be made without using expensive fabrication techniques such as injection molding.

These and other objects and features of the present invention will become more apparent from the following detailed description.

DETAILED DESCRIPTION

Figure 1:
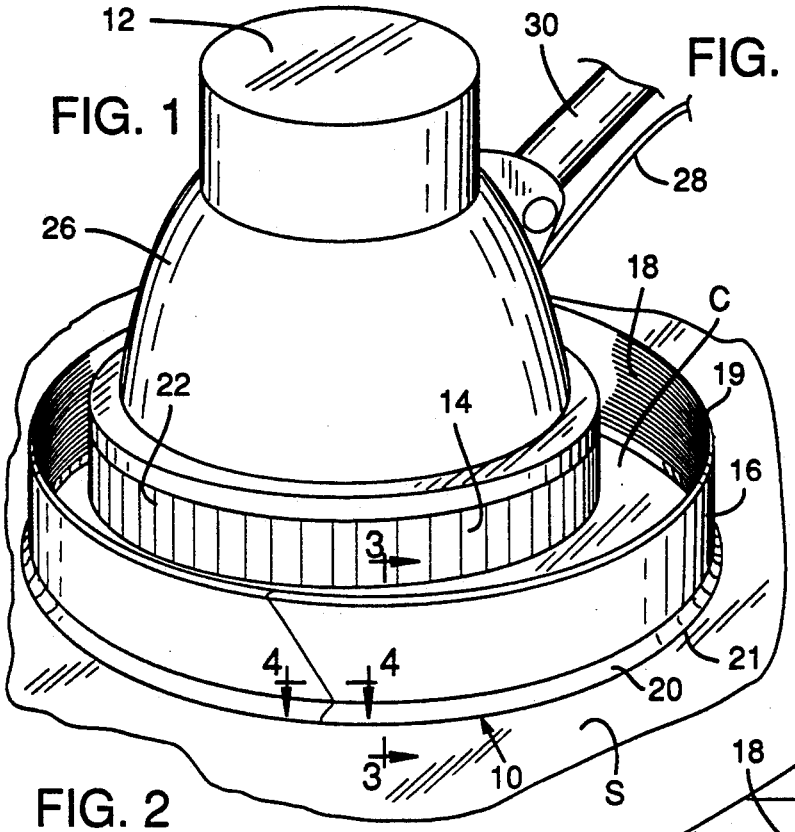
FIG. 1 is an elevational perspective view of a scrubber guard encompassing the rotary scrubbing mechanism of a floor cleaning apparatus.

FIG. 1 shows a scrubber guard 10 according to the present invention in operative position surrounding base 14 of cleaning apparatus 12. Cleaning apparatus 12 may be any floor scrubbing machine well known in the art. Scrubbing apparatus 12 typically has one or more rotating cleaning pads 22 positioned beneath base 14. The rotating cleaning pads 22 are driven by a motor 24 housed in a motor housing 26. Power is supplied to motor 24 by power cord 28. A handle 30, extending outwardly from and pivotally connected to the exterior surface of motor housing 26, allows a worker to guide scrubbing apparatus 12 along the surface S of a floor to be scrubbed or stripped.

Scrubbing apparatus 12 contacts surface S with cleaning pads 22 that are rotatably driven by motor 24. Electric motor 24 typically rotates cleaning pads 22 at a pad speed of approximately 175 to 300 rpm. A cleaning pad speed within this range produces a cleaning solution tangential velocity of about 750 to about 1000 feet per minute.

Scrubber guard 10 comprises a flexible, continuous, vertically extending annular wall. Continuous as used herein refers to an annular wall devoid of perforations therethrough. It has been found unnecessary to provide perforations in scrubber guard 10 since an adequate volume of cleaning solution passes under the guard as it moves across a floor. Because it is free floating and flexible, scrubber guard 10 rides up on the film of liquid on a floor when the scrubber mechanism is moved along the floor. In this way, the guard 10 allows ingress of new liquid in the natural course of operation. Similarly, guard 10 allows a controlled egress of liquid under bottom edge 21.

Scrubber guard 10 has a top edge 19, a bottom edge 21, a lower arcuate portion 20 located adjacent bottom edge 21, an exterior surface 16 and ribbed interior surface 18. Exterior surface 16 and ribbed interior surface 18 extend vertically upwardly from the surface S of a floor on which the scrubber 12 and scrubber guard 10 rests. Scrubber guard 10 and floor surface S define interior compartment C for receiving base 14 and scrubbing solution. Bottom edge 21 rests upon the floor when scrubber guard 10 surroundingly encompasses base 14.

Scrubber guard 10 is made of a flexible material that is sufficiently rigid as to be self-supporting when lower edge 21 rests on a surface, and sufficiently flexible so as to be capable of bending and conforming to obstacles contacting its exterior surface 16 or its interior surface 18. In fact, the scrubber guard 10 is sufficiently pliable to be folded for packaging and transportation. The scrubber guard 10 may be slightly deformed by such packaging but will regain its intended shape simply by allowing it to stand for about thirty minutes at room temperature. The process can be accelerated by placing the guard in warm to hot water.

Scrubber guard 10 can be made of a variety of materials including thermoplastics, nylon, polycarbonate, and the like. A number of fabrication techniques can be used. Ideally, one can mold a seamless guard 10. But, a particularly advantageous alternative is to make the guard from an extruded material having a cross-section of the type illustrated in FIG. 3. The extruded material is cut into lengths of about 3 feet to about 8 feet. The ends of the resulting strips are then joined to form annular scrubber guard 10.

Figure 3:
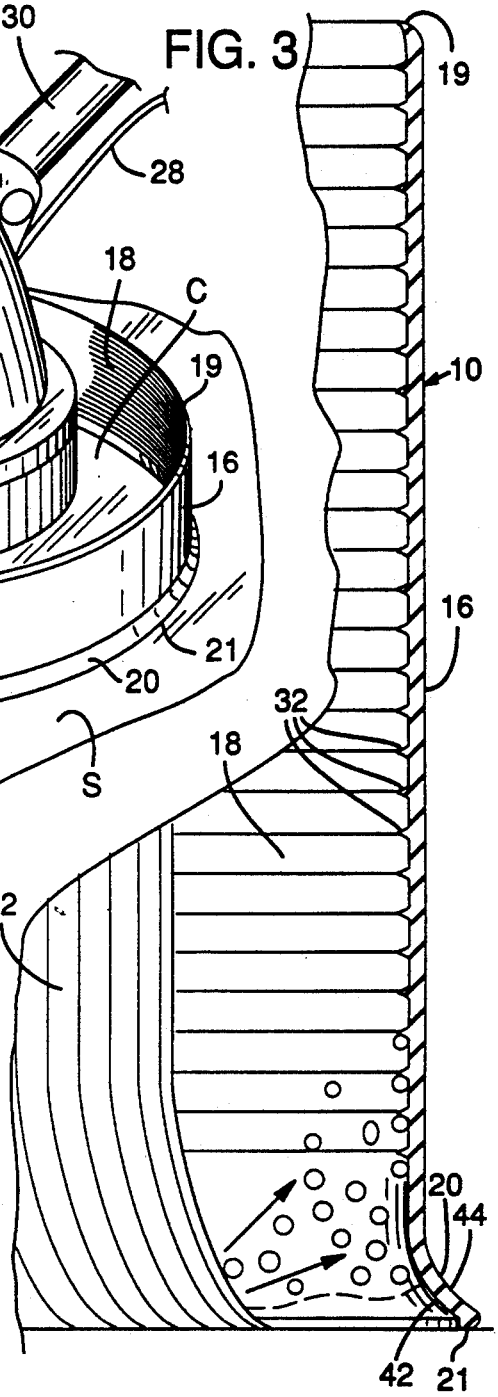
FIG. 3 is an enlarged, partial, sectional view of the scrubber guard, taken along line 3—3 of FIG. 1.
Figure 8:
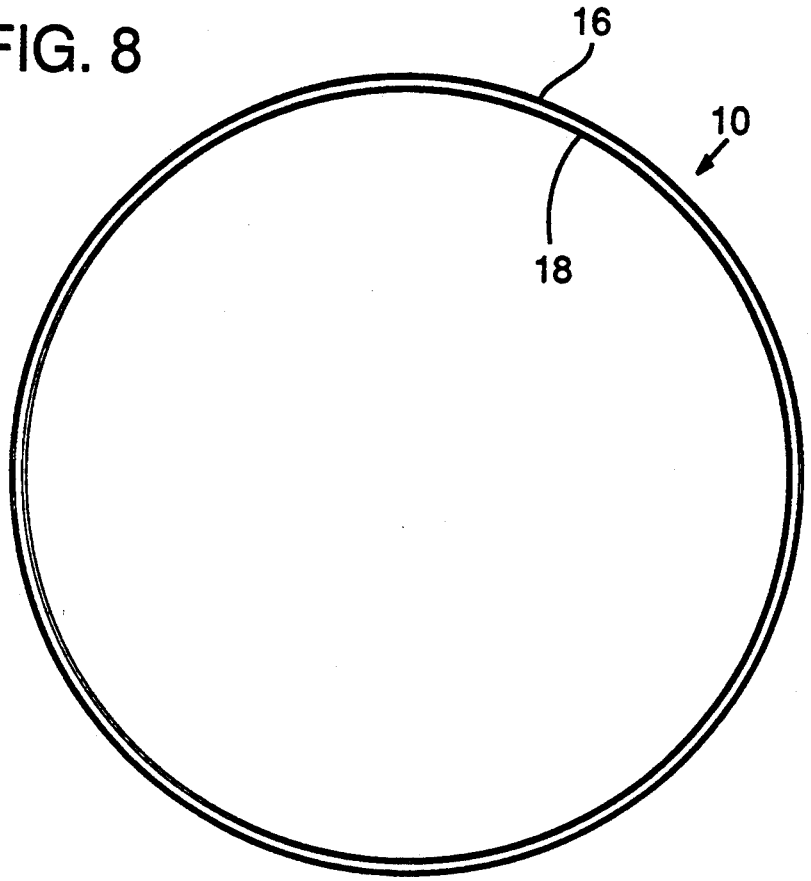
FIG. 8 is a top view of the scrubber guard indicating a curvature of the scrubber guard at rest.

A preferred embodiment of the scrubber guard is made of a polyvinyl chloride extrusion product produced by the Mercer Corporation of Florida. Such extrusions can be made in a variety of sizes, including the 6¼ inch wide extrusion shown in FIGS. 3 and 8. The illustrated extrusion has parallel ribs 32 on one surface. In the embodiment of FIGS. 3 and 8, ribs 32 extend latitudinally in a 5½ inch wide region adjacent top edge 19. Ribs 32 are spaced at intervals of about 1/16 inch.

Figure 5:
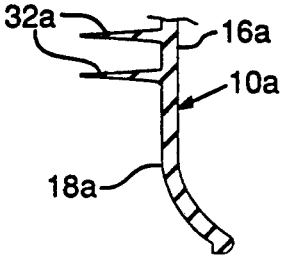
FIGS. 5–6 are enlarged, partial, sectional views taken along line 3—3 of FIG. 1 to show alternative configurations of the latitudinally spaced ribs that project from the interior surface of the scrubber guard.
Figure 6:
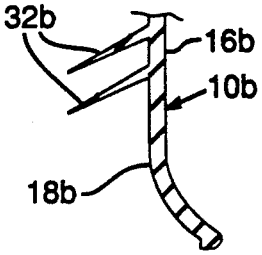

Ribs 32 reinforce the guard and prevent the guard from clinging to a surface of the scrubber. More importantly, as shown in FIG. 3, ribs 32 inhibit upward movement of liquid droplets thrown from pad 22. As shown in FIGS. 5 and 6, other rib configurations can be used. Adding one or more larger ribs as shown in FIGS. 5 and 6 can aid in inhibiting upward travel of splashed liquid.

Figure 4:
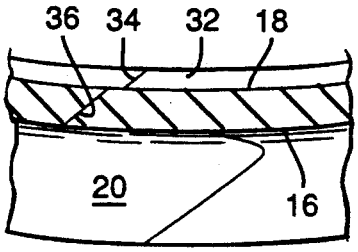
FIG. 4 is an enlarged, partial, sectional view of the scrubber guard, taken along line 4—4 of FIG. 1.
Figure 7:
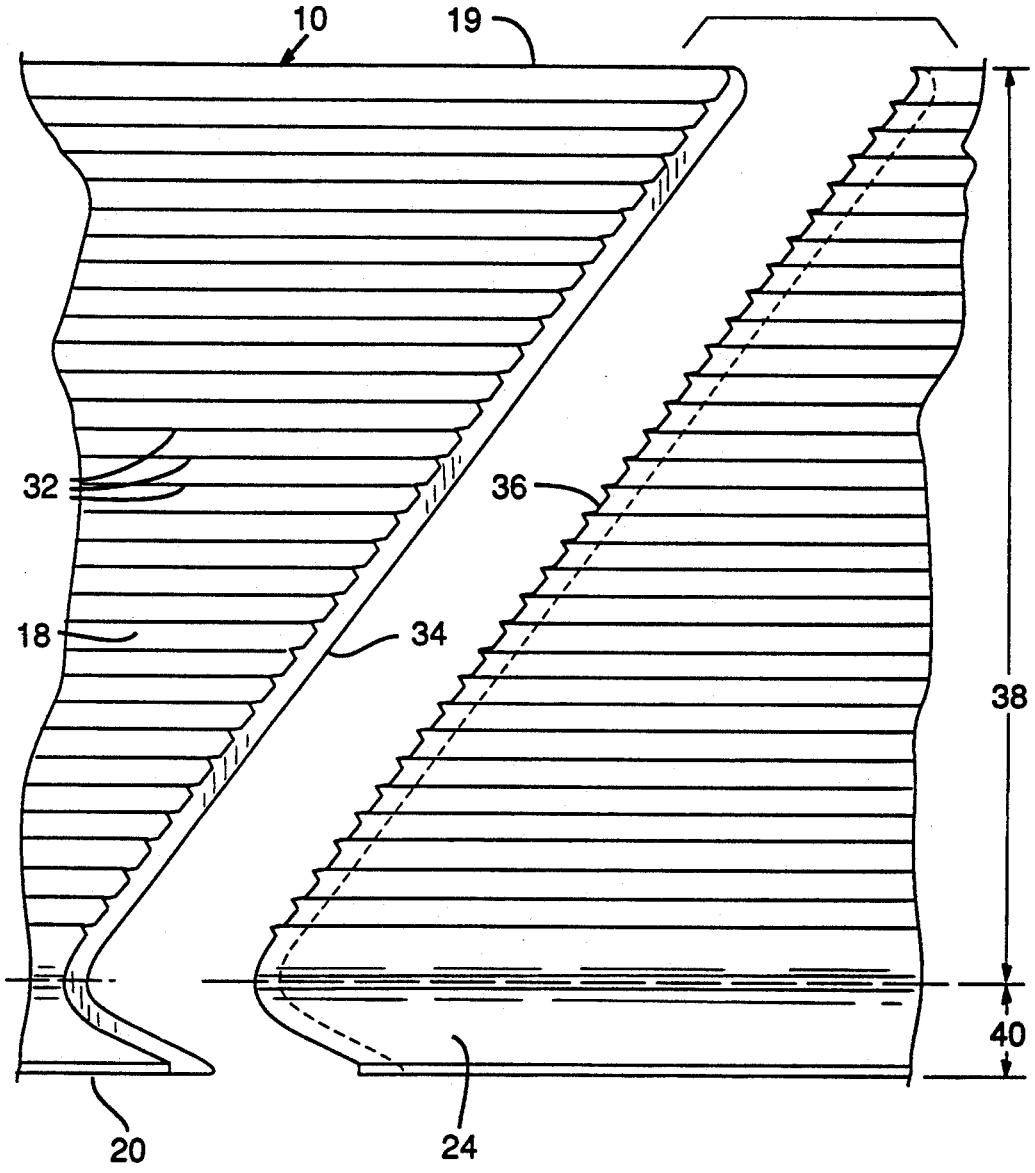
FIG. 7 is a side view of the interior surface of the scrubber guard indicating the curvature of a seam of the scrubber guard.

Scrubber guard 10 can be made to accommodate any size floor cleaning apparatus simply by selecting an extrusion strip of an appropriate length. Most advantageously, three feet to eight foot strips are cut with their ends at angles as shown in FIGS. 4 and 7 to form edges 34 and 36.

To provide the guard 10 with a smooth inner surface when using an extruded material, care must be taken in the design of the seam. The seam will be too weak if it is perpendicular to the top and bottom edges. Also, the ends of the strips should not overlap in such a fashion that the guard becomes unbalanced. Ideally, the guard 10 has a vertical cross-section and weight distribution that is identical around the entire ring. In the illustrated embodiment this is accomplished with edges 34 and 36 having an upper section 38 that extends to a level about 5½ inches below top edge 19, and a lower section 40 that extends upwardly to a level about ¾ inch from bottom edge 21. Upper section 38 is cut at an angle of about 55°–65° and lower section 40 is cut at a reverse angle of about 40°–50° relative to the edges of the extrusion as viewed from the side. FIG. 4 shows how both the upper section 38 and lower section 40 of edges 34 and 36 are bevelled at an angle of about 40°-50°. Cutting both ends of a strip in this manner creates the two bevelled, mutually fitting ends 34 and 36.

Ends 34 and 36 are joined to form annular scrubber guard 10. In a preferred embodiment, ends 34 and 36 are joined by an adhesive. Although any adhesive that firmly binds ends 34 and 36 will suffice, the preferred adhesive is Locktite 411. Locktite 411 is a cyanoacrylic ester produced by the Locktite Corporation. Ends 34 and 36 are adhered to form a continuous, flexible scrubber guard 10 that is ready for use.

Scrubber guard 10 defines a compartment C for receiving base 14. Base 14 substantially occupies compartment C along with a portion of the scrubbing solution placed on floor. To clean a floor, a worker moves scrubbing apparatus 12 transversely over the floor using handle 16 while maintaining base 14 inside compartment C.

Tangential cleaning solution exit (cleaning solution splash) is produced by the rotating scrubbing pads 22. Cleaning solution splash is contained within compartment C due to the presence of scrubber guard 10. FIG. 7 shows interior surface 19 of scrubber guard 10 having a plurality of parallel, latitudinally spaced ribs 32 that project outwardly approximately 1-5 mm from interior surface 18. Ribs 32 extend around the entire circumference of interior surface 18. Ribs 32 project inwardly into the interior of compartment C and intercept cleaning solution splash to a greater extent than a smooth interior surface.

Figure 9:
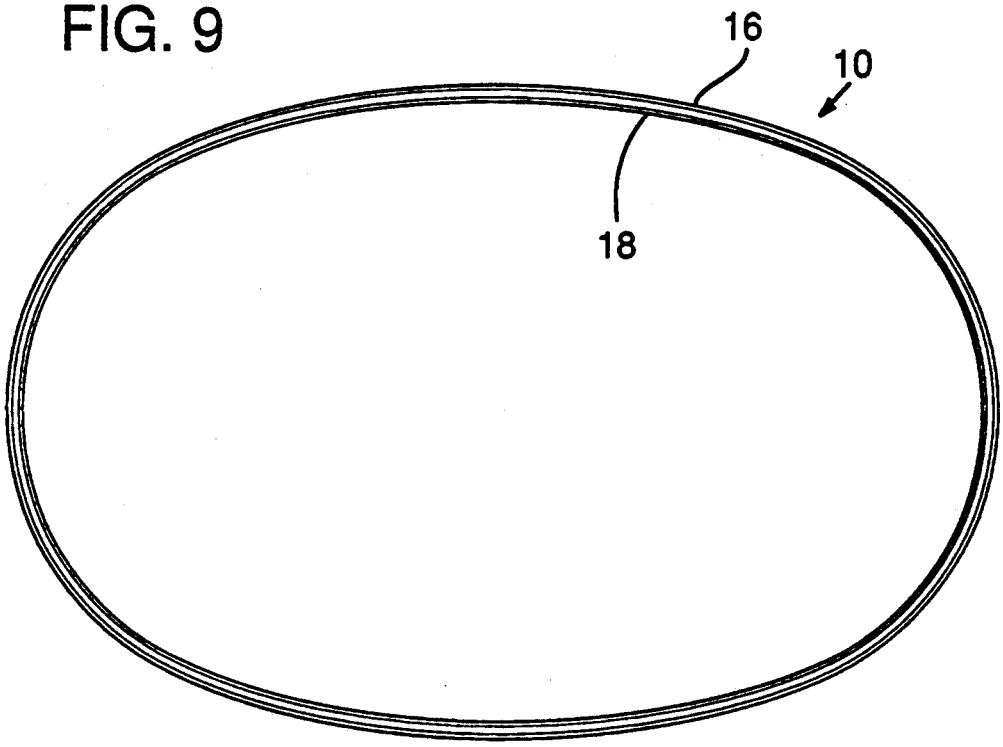
FIG. 9 is a top view of the scrubber guard deformed to an oval shape as a result of contact with a scrubber mechanism during use.

As scrubbing apparatus 10 moves transversely over the surface S of a floor, the interior surface 18 of scrubber guard 10 is repeatedly contacted by base 14. Scrubber guard 10 is sufficiently flexible to bend and conform to base 14 and to objects contacting exterior surface 16 or interior surface 18. Thus, to a viewer looking down from the top, scrubber guard 10 changes shape (horizontal cross-section) as it contacts objects during the scrubbing operation. For example, the guard may take the shape shown in FIG. 8 when first placed on the floor; then as the scrubber is used, the shape may change to that shown in FIG. 9 due to contact between the scrubber and the interior surface of the guard 10. This flexibility prevents scrubber guard 10 from tipping when opposing forces are generated on its exterior surface 16 and on its interior surface 18. Although there may be a substantial change in horizontal cross-section, the vertical cross-section, as shown in FIG. 3, does not vary.

Figure 2:
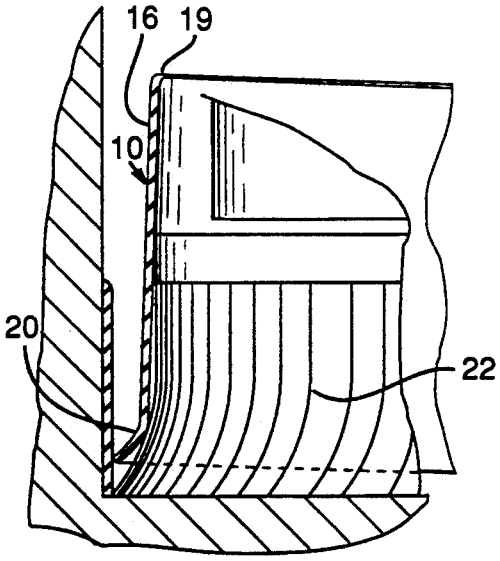
FIG. 2 is a partial sectional view of the scrubber guard showing the bottom arcuate portion of the scrubber guard lifting upwardly relative to the upper surface of a floor when contacting a vertical wall.

Bottom portion 40 of scrubber guard 10 includes approximately a ¾ inch section of the lower portion of interior and exterior surfaces 16 and 18. Bottom portion 40 is arcuate, having an interior convex surface 42 and an exterior concave surface 44. Arcuate bottom portion 40 allows guard 10 to rise upwardly relative to the surface S when exterior surface 16 contacts a vertically extending surface such as wall W as shown in FIG. 2. The force applied by scrubbing apparatus 12 on interior surface 18 will be opposed by a force applied by wall W on the exterior surface 16 of scrubber guard 10. However, these forces may not be directly opposed due to the arcuate bottom portion 40. The most likely explanation for this is that, due to its shape, the bottom portion 40 directs the force exerted by the scrubbing apparatus 12 slightly downward. An equal and opposite reaction causes guard 10 to rise upward slightly.

The flexibility of scrubber guard 10, along with its ability to lift slightly upward in response to forces applied on exterior surface 16 and its interior surface 18, prevents the scrubber guard 10 from tipping when encountering objects on exterior surface 16. Furthermore, the ability to lift slightly upward allows cleaning pads 22 of scrubbing apparatus 10 to come as close as possible to objects encountered by the scrubber guard 10.

The exterior surface 44 of bottom portion 40 is shaped like a ramp to slip below power cord 28 and prevent it from slipping beneath edge 33 and entangling with rotary cleaning pads 22. This in turn protects the operator of scrubbing apparatus 10 from possible electric shock.

Although the principles of the invention have been described and illustrated with reference to preferred embodiments, it should be apparent to one of ordinary skill in the art that the invention can be further modified in arrangement and detail without departing from such principles.

I claim:

1. A floor scrubber comprising:

a frame, scrubbing means attached to the frame for scrubbing or stripping a floor, and a drive means for moving the scrubbing means across the floor; and a flexible wall that encompasses the scrubbing means during a floor cleaning operation, the flexible wall having an exterior surface and an interior surface, the interior surface having parallel, latitudinally positioned ribs extending outwardly from and around the circumference of the interior surface, an upper edge, and a lower edge, the wall being sufficiently flexible to bend and conform to objects contacting the interior or exterior surface.

2. A floor scrubber comprising:

a frame, scrubbing means attached to the frame for scrubbing or stripping a floor, and a drive means for moving the scrubbing means across the floor; and a flexible, water-impermeable wall for encompassing the scrubbing means, the flexible wall having continuous exterior and interior surfaces, the interior surface having parallel, latitudinally positioned ribs extending outwardly from and around the circumference of the interior surface, an upper edge, a bottom edge, and a lower arcuate portion located adjacent the bottom edge, the wall being sufficiently flexible to bend and conform to objects contacting the interior or exterior surface.

3. A guard for a floor scrubbing machine comprising a ring that has an interior surface and an exterior surface, the guard being made from a single length of an extruded material, the length having two mating ends which are joined by an adhesive to form a seam, each end being cut at an angle of about 40-50 degrees relative to an upper portion of the interior and exterior surfaces as viewed from the top and at least partially at an angle of about 55-65 degrees relative to the upper edge as viewed from the side.

4. A guard for a floor scrubbing machine comprising an annular wall that encompasses a scrubbing machine during a floor scrubbing or stripping operation, the annular wall having vertically extending interior an exterior surfaces and a plurality of substantially parallel, latitudinally positioned ribs extending from and around the interior surface of the annular wall, a top edge, and a bottom edge which rests on the floor when the guard is in use, the annular wall being sufficiently pliable to bend and conform to objects contacting the interior or exterior surface.

5. A guard for a floor scrubbing machine comprising a water-impermeable annular wall having continuous, vertically extending interior and exterior surfaces, substantially parallel, latitudinally positioned ribs extending outwardly from and around the circumference of the interior surface of the annular wall, a top edge, and a bottom edge that rests on the floor when the guard is in use, the annular wall defining a compartment for receiving a scrubbing machine, the wall being sized and shaped such that scrubbing solution splashed by the scrubbing machine is contained within the compartment by the annular wall.

6. A scrubber apparatus comprising:

a frame;

a scrubber attached to the frame for frictional contact with a floor;

a drive mechanism for moving the scrubber in relation to the floor; and a flexible skirt having a top edge, a bottom edge that rests on the floor with the skirt encompassing the scrubber, and continuous interior and exterior surfaces wherein the interior surface includes substantially parallel, latitudinally positioned ribs extending around the circumference thereof, the skirt defining a compartment which contains the scrubber and scrubbing solution, the skirt being of a suitable size and shape to contain cleaning solution splashed by the action of the scrubber.

7. A guard for a floor scrubbing machine comprising an annular wall that encompasses a scrubbing machine during a floor scrubbing or stripping operation, the annular wall having vertically extending interior and exterior surfaces, a top edge, and a bottom edge which rests on the floor when the guard is in use, the annular wall being sufficiently pliable to bend and conform to objects contacting the interior or exterior surface, wherein the guard is made from a single length of an extruded material, the length having two mating ends which are joined by an adhesive to form a seam, each end being cut at an angle of about 40–50 degrees relative to an upper portion of the interior and exterior surfaces as viewed from the top and at least partially at an angle of about 55–65 degrees relative to the upper edge as viewed from the side.

8. A guard for a floor scrubbing machine comprising an annular wall that encompasses a scrubbing machine during a floor scrubbing or stripping operation, the annular wall having a plurality of parallel, latitudinally positioned ribs extending from and around an interior surface of the annular wall.

* * * * *